US009309603B2

(12) United States Patent
Woodruff

(10) Patent No.: US 9,309,603 B2
(45) Date of Patent: Apr. 12, 2016

(54) COMPONENT CLEANING IN A METAL PLATING APPARATUS

(75) Inventor: Daniel J. Woodruff, Kalispell, MT (US)

(73) Assignee: APPLIED Materials, Inc, Santa Clara, CA (US)

( * ) Notice: Subject to any disclaimer, the term of this patent is extended or adjusted under 35 U.S.C. 154(b) by 915 days.

(21) Appl. No.: 13/232,152

(22) Filed: Sep. 14, 2011

(65) Prior Publication Data

US 2013/0061875 A1 Mar. 14, 2013

(51) Int. Cl.

| | |
|---|---|
| ***B08B 7/00*** | (2006.01) |
| ***B08B 7/04*** | (2006.01) |
| ***C25D 17/00*** | (2006.01) |
| ***C25D 21/08*** | (2006.01) |

(52) U.S. Cl.

CPC ..... *C25D 17/001* (2013.01); *C25D 17/004* (2013.01); *C25D 21/08* (2013.01)

(58) Field of Classification Search

CPC ..... C25D 17/001; C25D 17/004; C25D 21/08
USPC ..... 134/6, 104.2; 204/242, 275.1
See application file for complete search history.

(56) References Cited

U.S. PATENT DOCUMENTS

| | | | | |
|---|---|---|---|---|
| 5,730,801 | A | 3/1998 | Tepman et al. | |
| 6,224,670 | B1 * | 5/2001 | Ishida | 118/70 |
| 6,280,581 | B1 | 8/2001 | Cheng | |
| 6,312,569 | B1 | 11/2001 | Suzuki et al. | |
| 6,632,335 | B2 | 10/2003 | Kunisawa et al. | |
| 7,033,465 | B1 * | 4/2006 | Patton et al. | 204/227 |
| 7,169,269 | B2 | 1/2007 | Mizohata et al. | |
| 7,390,383 | B2 * | 6/2008 | McHugh et al. | 204/273 |
| 7,931,786 | B2 * | 4/2011 | Wilson et al. | 204/273 |
| 2002/0144900 | A1 | 10/2002 | Keigler | |
| 2005/0061676 | A1 | 3/2005 | Wilson et al. | |
| 2005/0106834 | A1 | 5/2005 | Andry | |
| 2008/0190757 | A1 | 8/2008 | Zimmerman et al. | |
| 2010/0155254 | A1 * | 6/2010 | Prabhakar et al. | 205/157 |

FOREIGN PATENT DOCUMENTS

| | | | |
|---|---|---|---|
| JP | 2001-234399 | A | 8/2001 |
| JP | 2002-097599 | A | 4/2002 |
| JP | 2003-147597 | A | 5/2003 |

OTHER PUBLICATIONS

Korean Intellectual Property Office, International Search Report and Written Opinion for PCT/US2012/052238, Feb. 7, 2013.
Chinese State Intellectual Property Office, Notice of First Office Action in CN Application No. 2012800482766 (Aug. 20, 2015).

* cited by examiner

*Primary Examiner* — Alexander Markoff
(74) *Attorney, Agent, or Firm* — Kenneth H. Ohriner; Perkins Coie LLP

(57) ABSTRACT

A plating apparatus includes a vessel for holding a bath of plating liquid. A head is adapted to hold a work piece, such as a silicon wafer, in the vessel, with a seal on the head sealing against the work piece. A component cleaner assembly may be used to automatically clean a component of the plating apparatus, such as a seal or a contact ring. The cleaner assembly has a component contactor, such as a brush, on an arm. An arm actuator is linked to the arm for moving the arm from a retracted position, to a deployed position, where the contactor is in physical contact with the component. A method for cleaning a component of a plating apparatus includes moving a scrubber or contactor into contact with the component and applying a cleaning liquid onto the component adjacent to the contactor.

16 Claims, 8 Drawing Sheets

COMPONENT CLEANING IN A METAL PLATING APPARATUS

BACKGROUND OF THE INVENTION

The field of the invention is metal plating apparatus and methods as used in semiconductor manufacturing and in related micro-scale device manufacturing.

Microelectronic and other micro-scale devices are generally manufactured by plating layers of materials onto a substrate, such as a silicon wafer, to produce a large number of individual devices. Metal layers are plated onto the substrate to form electrically conductive patterns and for other applications as well. The metal layers may be plated onto the substrate using various plating apparatus, for example as described in U.S. Pat. No. 7,390,383; U.S. 2006-0237323 A1; U.S. Pat. Nos. 7,931,786; and 7,585,398, each incorporated herein by reference. The plating apparatus often have rotor that rotates the substrate in a bath of electrolyte during the plating process. A seal may be provided on the rotor in some designs, to seal off electrical contacts from the electrolyte.

In use, metal tends to accumulate on the seal. This degrades the electrical current path in the plating apparatus, which correspondingly degrades the quality of the plated metal layer. Often, other components of a plating apparatus can also benefit from cleaning. Accordingly, there is a need for improved techniques for cleaning seals and other components in plating apparatus.

SUMMARY OF THE INVENTION

In a first aspect, a plating apparatus includes a vessel for holding a bath of plating liquid. A head is adapted to hold a work piece in the vessel, with a component of the head, such as a seal, exposed to undesirable accumulation of plating liquid chemicals or other contamination. A component cleaning assembly may be used to automatically clean the component. The cleaning assembly may have a contactor, such as a brush, on an arm. An arm actuator is linked to the arm for moving the arm from a retracted position, to a deployed position, where the contactor is in physical contact with the component. The apparatus described may similarly be used to clean seals and other plating apparatus components.

In another aspect, a method of cleaning a seal or other component in a plating apparatus includes moving a scrubber or contactor into contact with the seal and applying a cleaning liquid onto the component adjacent to the contactor. The seal or other component is rotated while in contact with the contactor, or the component may remain stationary while the contactor moves over or around the component. At least some of the used cleaning liquid is collected.

Other and further features and advantages are described below. The invention resides as well in sub-combinations of the elements and steps described.

BRIEF DESCRIPTION OF THE DRAWINGS

In the drawings, the same element number indicates the same element in each of the views.

DETAILED DESCRIPTION OF THE DRAWINGS

Figure 1:
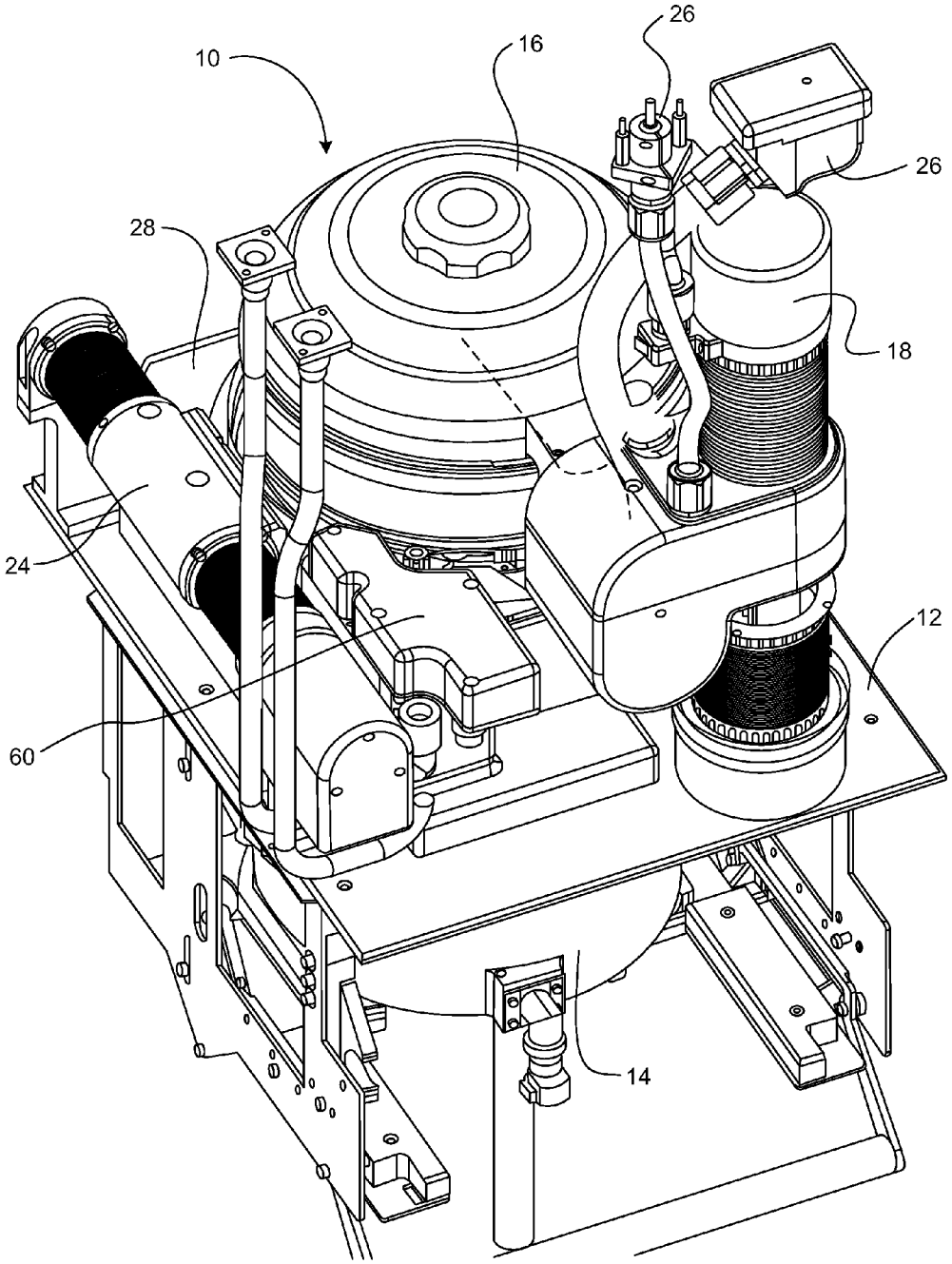
FIG. 1 is a perspective view of a plating apparatus.
Figure 2:
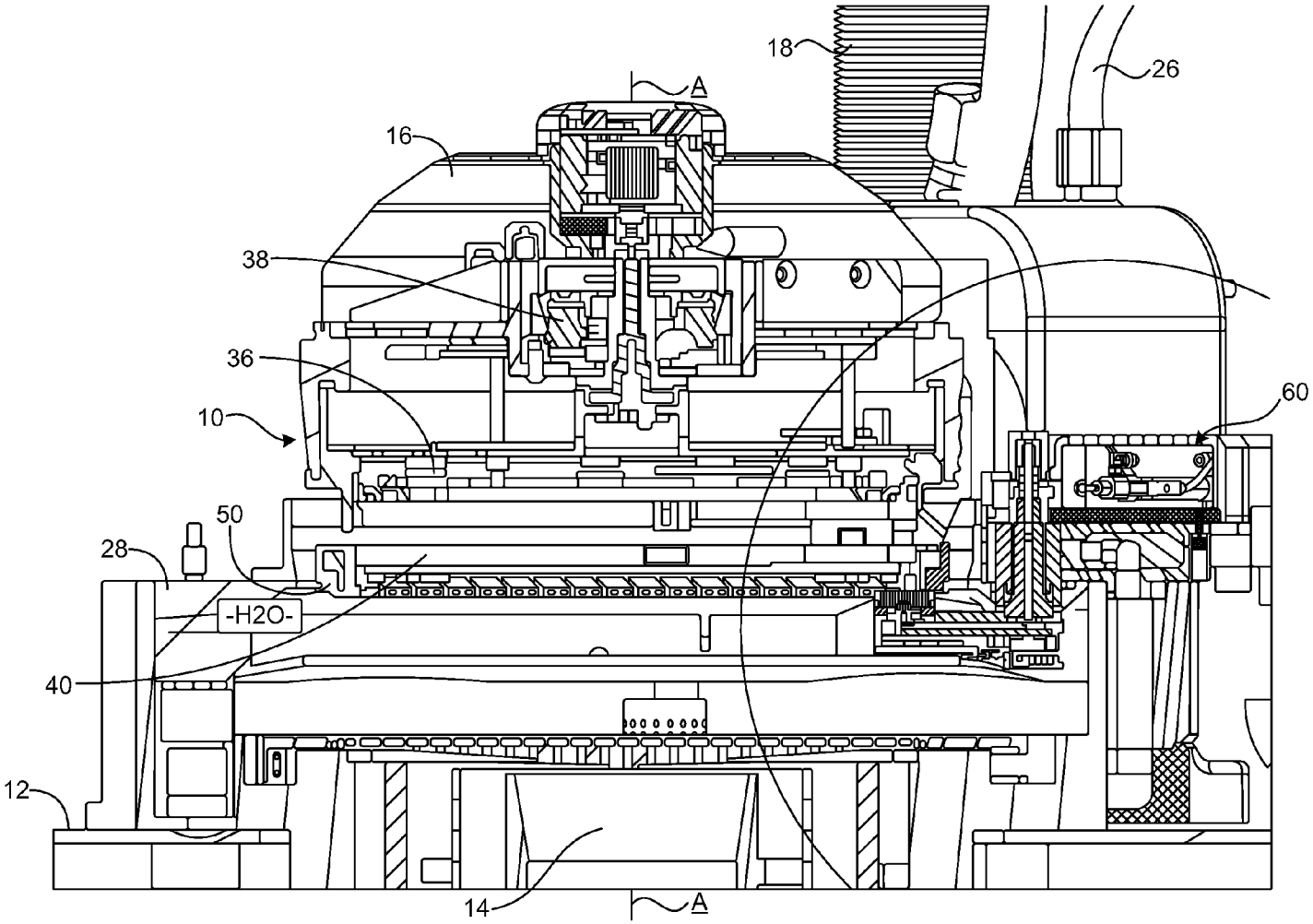
FIG. 2 is a section view of the plating apparatus shown in FIG. 1.
Figure 3:
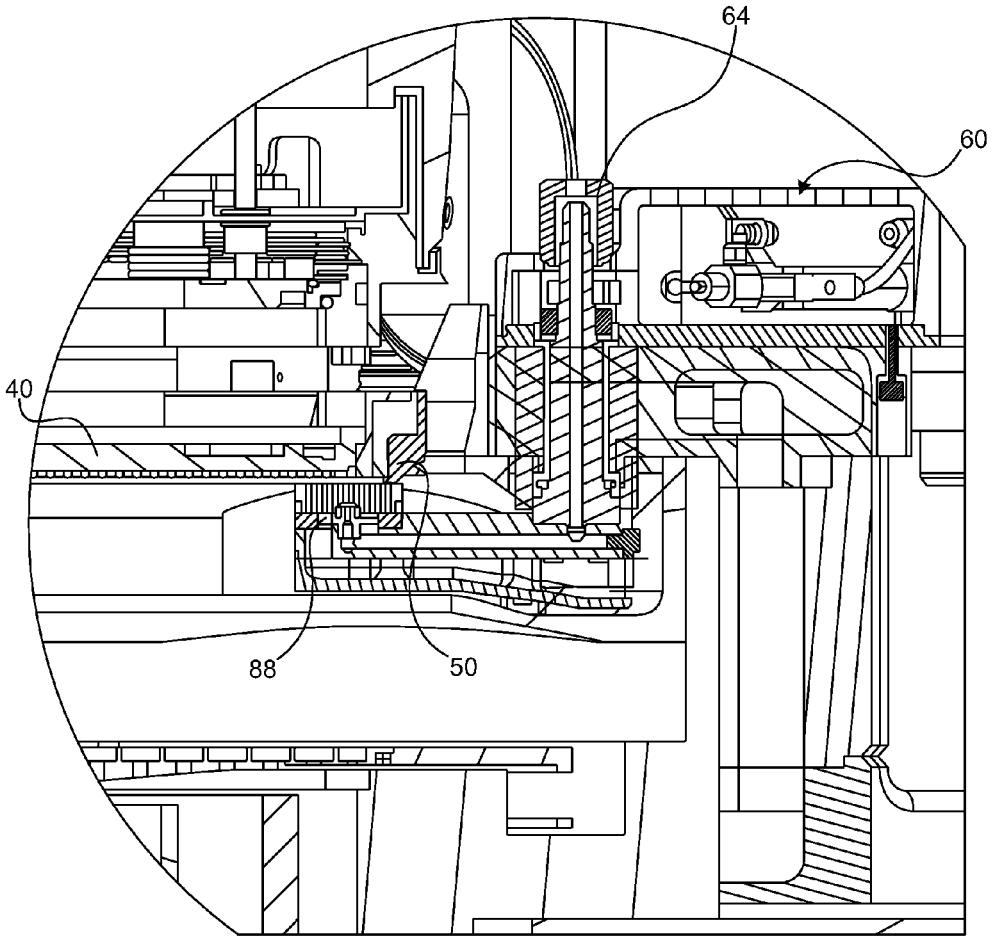
FIG. 3 is an enlarged detail of the cleaning module shown in FIG. 2.

As shown in FIGS. 1 and 2, a plating apparatus 10 is supported on a deck 12 and has a vessel 14 for holding plating liquid. A lift/rotate mechanism 18 on the deck 12 lifts and rotates a head 16, for example as described in the International Patent Publications referenced above. A rotor 36 in the head 16 may be rotated by a motor 38. The rotor 36 is adapted to hold a work piece, and may include a backing plate 40. Referring now also to FIG. 3, a seal 50 on the rotor 36 seals against the work piece to isolate plating ring contacts from the plating liquid, in a so-called sealed ring design.

The plating apparatus 10 may optionally include an agitator plate in the vessel 14, with the agitator plate moved back and forth via an actuator 24. Typically, an array of apparatus 10 is provided in an automated system, with one or more robots loading and unloading work pieces into and out of the apparatus 10. Electrical power and control cables 26 may extend up from the apparatus 10 to make overhead connections with the system. As shown in FIGS. 1, 2, 4 and 5, apparatus may include a rinse rim or frame 28 having a liquid collection opening 30 around the vessel 14. The liquid collection opening is typically connected to a vacuum source via fittings 32. In some processes, the apparatus 10 may perform an in-situ rinse of the work piece by positioning the work piece in vertical alignment with the liquid collection opening 30, and spraying a rinse liquid onto the rotating work piece. The rinse liquid is then flung off into the liquid collection opening 30 and drained away or aspirated.

Figure 6:
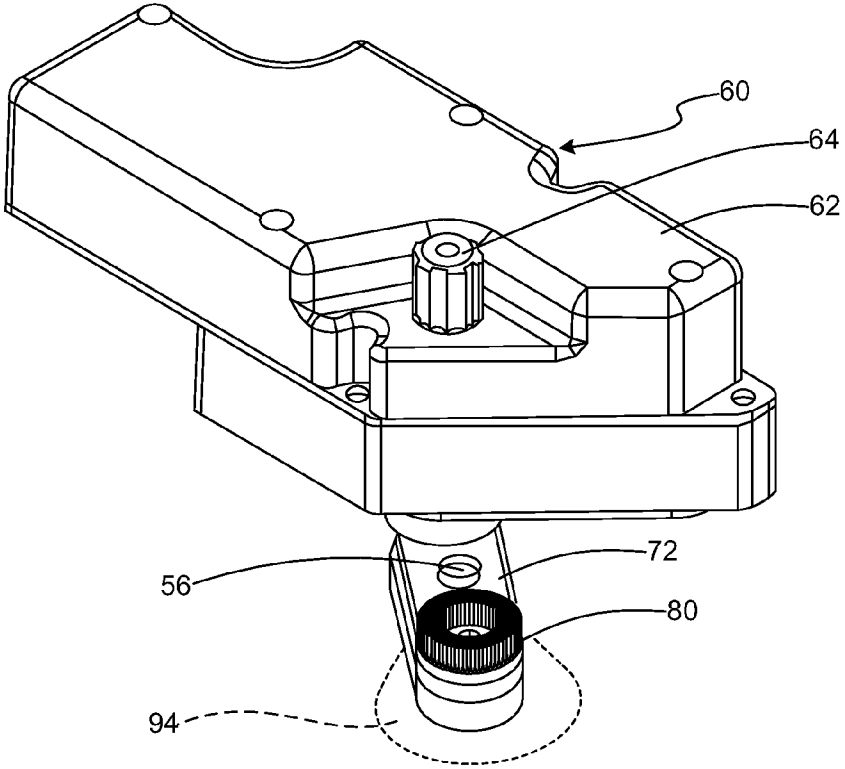
FIG. 6 is a top perspective view of the cleaning module alone.
Figure 7:
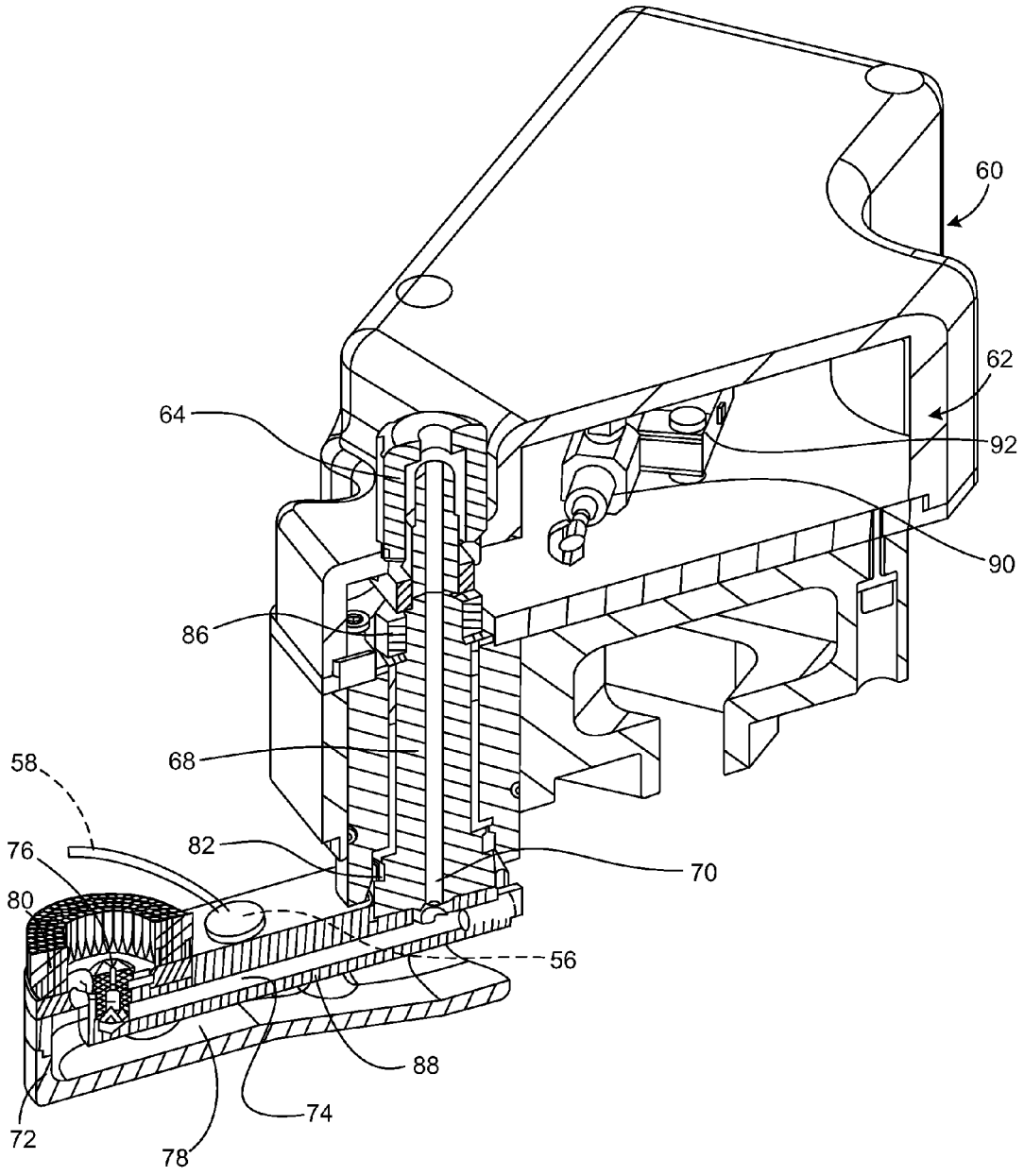
FIG. 7 is a top section view of the cleaning module as shown in FIG. 6.
Figure 8:
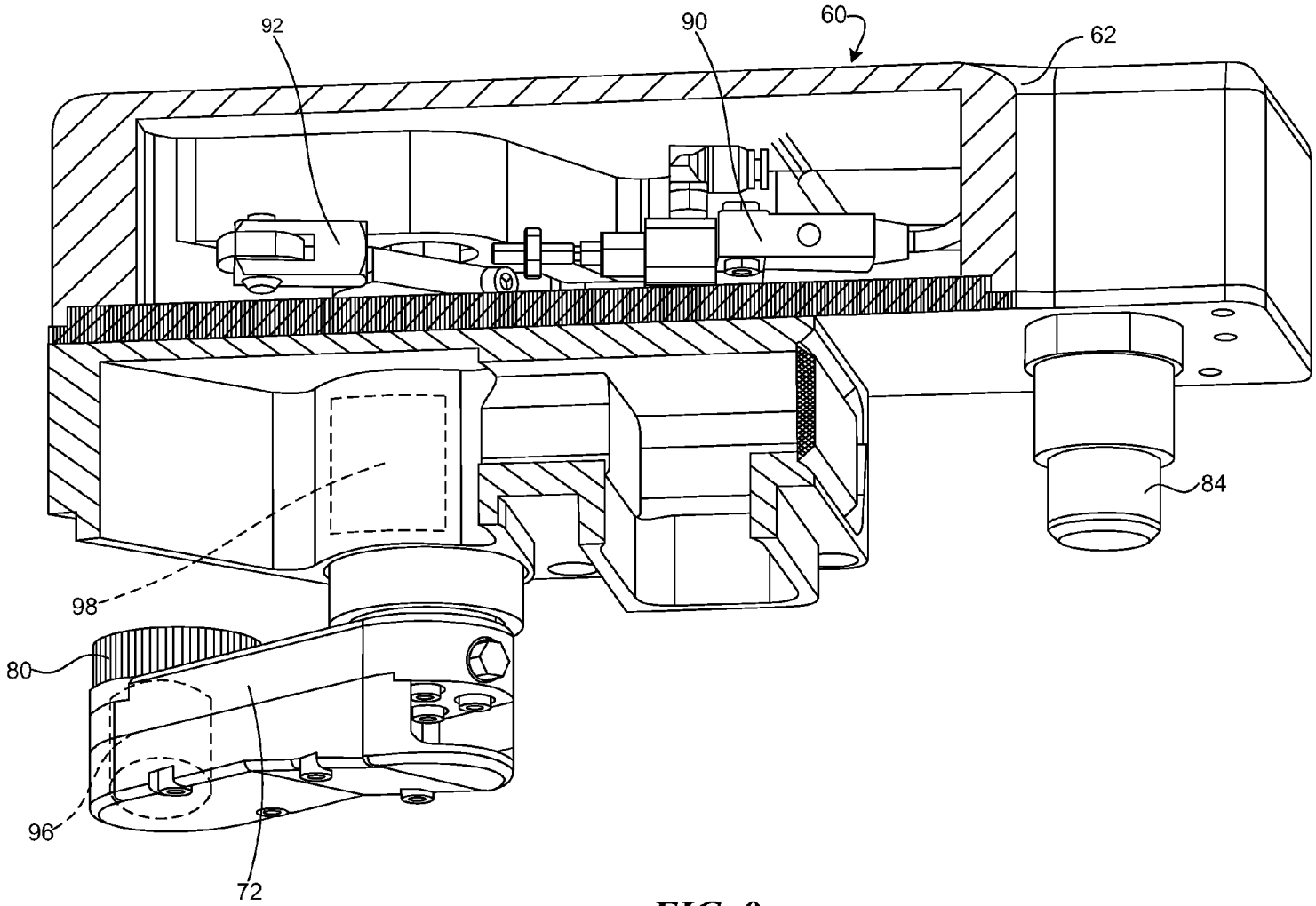
FIG. 8 is bottom perspective view and section view of the cleaning module.

Turning now to FIGS. 6, 7 and 8, a cleaning module or assembly 60 is shown with an arm 72 pivotally attached to a housing 62. As best shown in FIG. 7, the inner end of the arm 72 is joined to a shaft 68 supported on the housing 62 via seals 82 and bearings 86. The upper end of a bore 70 in the shaft extends into a fitting 64. The lower end of the bore connects into a duct 74 in the arm 72. A contact element 80 is provided on an up-facing surface at the outer end of the arm 72. The contact element 80 may be a brush, sponge, abrasive pad, plastic or rubber cup or squeegee, or a similar element adapted to scrub metal particles off of the seal 50. The contact element 80 may have a specific contour or shape to match the shape of the component to be cleaned. For example, for cleaning a seal having a semi-circular cross section, a brush having bristles contoured into a semi-circle may be used.

One or more nozzles 76 connecting to the fluid duct 74 may be provided on the arm 72, to spray a cleaning liquid onto the seal 50. In the example shown in FIG. 7, a single nozzle 76 is centrally located within an annular contact element 80, in this case, an annular brush.

The arm may also include a return duct 78 extending on or through the arm from collection or drain openings 88 at the outer end of the arm. Used cleaning liquid may be collected via the used liquid draining through the collection openings 88, into the return duct 78, and then into the rinse rim 28. The arm 72 may be angled upwardly, allowing the used liquid to drain out via gravity. Alternatively, an aspiration line or hose may optionally be connected to the return duct 78 at the inner end of the arm.

As shown in FIG. 8, an actuator 90, for example an electric or pneumatic actuator, is connected to a linkage 92 attached to the shaft 68. Cables or pneumatic lines from the actuator 90 extend out of the housing 62 via a fitting or connector 94. A cleaning liquid is provided into the duct 74 via the plumbing fitting 64. A gas, such as nitrogen or clean dry air may optionally be used as a supplemental cleaning fluid, for example, to help dry the seal, or other cleaned component, at the end of the cleaning process. If used, the gas source may be connected to the fitting 64, or to a separate dedicated gas fitting and flow path leading to the nozzle 76, or other openings at the outer end of the arm 72. Operation of the actuator 90 and supply of cleaning liquid may be controlled by a system computer controller, which typically controls various other operations of the plating apparatus 10.

Also as shown in FIG. 8, a motor 96 may optionally be included in the arm to rotate the brush or other seal contact element 80. As shown in FIG. 6, a catch cup 94 may be provided on the outer end of the arm 72.

Referring to FIGS. 2 and 3, the cleaning module 60 may be mounted on top of the rinse rim or frame 28. With existing plating apparatus having a rinse rim 28, the cleaning module 60 may be retrofit or added with only minor changes to the rinse rim.

In a typical plating method, a substrate is held in the rotor 36 against the seal 50. The head 16 is then moved to place the substrate into contact with a bath of plating liquid in the vessel 14. Electrical current is passed through the plating liquid to cause metal in the plating liquid to deposit onto the substrate. The substrate is then moved out of the bath of plating liquid. The head 16 is optionally inverted and the substrate is removed from the rotor. Briefly, to then clean the seal, the seal is moved into contact with a seal contactor 80, such as a brush. A cleaning liquid is applied onto the seal adjacent to the seal contactor. Used cleaning liquid may be collected, to avoid contaminating the bath of plating liquid. The seal is rotated by rotating the rotor, while the seal is in contact with the seal contactor. After the seal is cleaned, the seal contactor is moved away from the seal, and back to a storage position, for example within the liquid collection opening 30. Other components of a plating apparatus, such as a contact ring or backing plate, may be cleaned using a similar process. In some applications, it may not be necessary or desirable to physically contact the component to be cleaned. In these cases, cleaning may be achieved via liquid spray without touching the component with a contact element.

Figure 4:
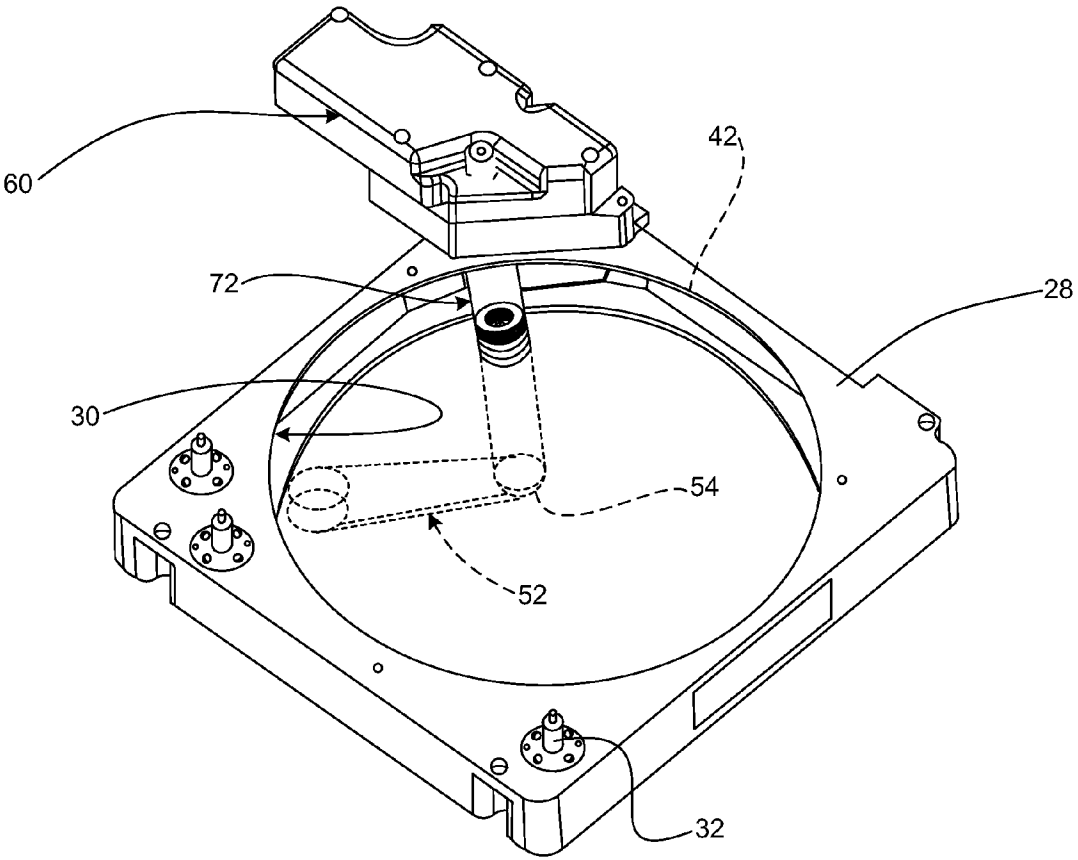
FIG. 4 is a perspective view of the cleaning module shown in FIGS. 2 and 3 attached to the rinse rim or frame shown in FIG. 1, with the arm of the module in deployed position.
Figure 5:
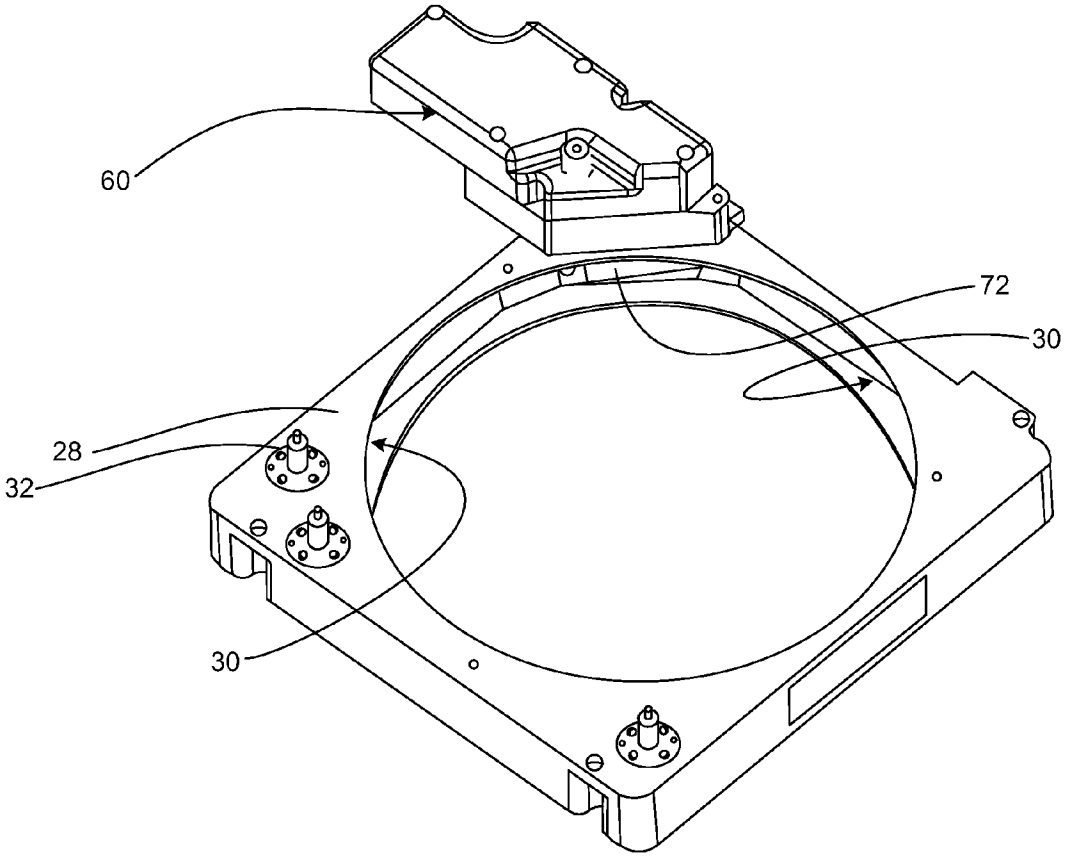
FIG. 5 is a perspective view of the cleaning module as shown in FIG. 4, with the arm now in a retracted or stored position.

In use, the arm 72 of the cleaning module 60 is ordinarily in the retracted position shown in FIG. 5, so as not to interfere with movement of the rotor 36 into and out of the vessel 14. The work piece processed in the apparatus is removed, so that the rotor 36 is not holding any work piece. To clean the seal 50, the lift/rotate mechanism 18 moves the head into the position shown in FIGS. 2 and 3. This vertically aligns the seal 50 with the contact element 80. The actuator 90 drives the linkage 92 to swing the arm 72 from the stored position shown in FIG. 5, into the deployed position shown in FIGS. 2-4, 6 and 7. A cleaning liquid is provided to the nozzle via the fitting 64, the bore 70 and the liquid duct 74. Aspiration may optionally be provided to the return duct 78.

With the brush or other contact element 80 in contact with the seal 50, the rotor 36 is slowly rotated via the motor 38. The contact element 80 scrubs contamination off of the seal. The contamination is generally metal particles and/or chemical residues or salts. The rotor continues to rotate the seal over the contact element 80 until the entire seal has been scrubbed at least once. The cleaning liquid lubricates the seal to avoid excess wear of the seal during the cleaning process. The cleaning liquid also carries away scrubbed off particles. The contact pressure of the contact element 80 against the seal 50 may be adjusted by lifting or lowering the head 16. The duration of the cleaning process may vary depending on the seal material and other factors. The cleaning process may be performed after each work piece is plated, or after a selected number of work pieces have been plated.

After the cleaning process is complete, the actuator 90 reverses to move the arm back into the retracted position shown in FIG. 5. While ordinarily the arm 72 is either in the deployed or retracted positions shown in FIGS. 4 and 5, optionally, the arm 72 may also be moved into intermediate positions, for example, to concentrate cleaning on an outer edge of the seal 50. As shown in FIG. 8, an arm lifter 98 may also optionally be used to make vertical adjustments to the arm 72, instead of, or in combination with, adjusting the vertical position of the head via the lift/rotate mechanism 18.

Often, since even small changes to the plating liquid in the vessel can degrade plating performance, it is advantageous to minimize the amount of component cleaning liquid released into the vessel. Referring to FIGS. 3 and 7, the cleaning module 60 is designed to collect most or all of the used cleaning liquid. The contact element 80, if provided in an annular shape surrounding the nozzle 76, tends to contain the cleaning liquid. The collection openings 88 in the annular space between the contact element 80 and the nozzle 76 help to remove used cleaning liquid. As shown in FIG. 6, a catch cup 94 may also be provided on the outer end of the arm 72 to catch any used cleaning liquid dripping from the arm.

Also as shown in FIG. 6, a sensor 56 may be provided on the arm 72 to sense whether contaminants remain on the seal 50. The sensor 56 may be an optical sensor including a light source, that detects a color or contrast change. The sensor may also detect other parameters, for example using one or more contact probes 58, that contact the seal 50, to detect the presence of metal on the seal, or to measure an electrical resistance change on the seal.

FIG. 4 shows an alternative arm 52 having two segments or links, with the outer end of inner segment positionable at the rotor or seal rotation axis AA (shown in FIG. 2), and an outer segment rotatable about the axis AA via a motor 54. With this design, the seal may remain stationary while the contactor or brush 80 moves in a circle around the seal or other component.

Referring still to FIG. 4, a contactor or brush cleaning station 42 may be provided within the rinse rim. If used, the brush cleaning station 42 may include a scrubbing pad or surface and/or spray nozzles. With the arm in the stored position as shown in FIG. 5, the brush 80 is moved into the cleaning station where the contactor or brush itself may optionally be cleaned.

Although described as directed to cleaning a seal on a plating apparatus, each embodiment described may also be used to clean other plating apparatus components as well, for example a ring contacts or a backing plate.

Thus, novel method and apparatus have been shown and described. Various changes and modifications may of course be made without departing from the spirit and scope of the invention. The invention, therefore, should not be limited, except by the following claims, and their equivalents.

What is claimed is:

1. Plating apparatus, comprising:

a vessel for holding a bath of plating liquid;

a rinsing frame on the vessel;

a head having a rotor for holding and rotating a work piece;
a seal on the rotor;
a head lifter attached to the head; and
a seal cleaning assembly including a pivot arm having a first end and a second end, a contactor on the second end of the pivot arm, and an arm actuator linked to the pivot arm for moving the pivot arm from a retracted position to a deployed position, with the contactor in physical contact with the seal when the head lifter holds the rotor at a first position over the vessel and the pivot arm is in the deployed position; and
with the first end of the pivot arm pivotally supported inside of the rinsing frame in both the deployed position and in the retracted position.

2. The apparatus of claim 1 with the frame comprising a liquid collection opening connected to a vacuum source, and with the pivot arm at least partially within the liquid collection opening when the pivot arm is in the retracted position.

3. The apparatus of claim 1 wherein the pivot arm comprises a single segment.

4. The apparatus of claim 1 with the pivot arm at a fixed vertical position relative to the vessel.

5. The apparatus of claim 1 wherein an entire circumference of the seal is contacted by the contactor by positioning the pivot arm in the deployed position and by rotating the rotor.

6. An electroplating apparatus, comprising:
a vessel holding a bath of plating liquid;
a rinsing frame on the vessel;
a head including work piece holder;
a head lifter attached to the head;
a component cleaning assembly having a pivot arm with a first end and a second end;
a contactor on the second end of the pivot arm, and a pivot arm actuator linked to the pivot arm for moving the pivot arm from a retracted position to a deployed position, and with the first end of the pivot arm pivotally supported inside of the rinsing frame in both the retracted position and in the deployed position.

7. The apparatus of claim 6 with the contactor on a top surface of the second end of the pivot arm for physically contacting a down-facing component on the head.

8. The apparatus of claim 6 with the head further including:
a rotor and a rotation motor for rotating the rotor;
a seal around a perimeter of the rotor; and
with the contactor aligned under the seal when the pivot arm is in the deployed position.

9. An electroplating apparatus, comprising:
a plating bath vessel;
a rinsing frame on the vessel;
a head including a rotor having a seal and a work piece holder, and a motor for rotating the motor;
a head lifter attached to the head;
a component cleaning assembly for cleaning the seal while the rotor is rotating, including a contactor on an upper surface of an outer end of a pivot arm, and a pivot arm actuator attached to the pivot arm, with the pivot arm movable via the pivot arm actuator from a retracted position to a deployed position wherein the contactor is in physical contact with the seal on the rotating rotor, to clean the seal; and
the pivot arm is pivotally supported in both the deployed and retracted positions inside of the rinsing frame.

10. The apparatus of claim 9 with the pivot arm having a fixed vertical position relative to the vessel.

11. The apparatus of claim 9 with the contactor comprising a brush, a pad or a blade.

12. The apparatus of claim 9 further including a contactor spin motor on or in the pivot arm and attached to the contactor.

13. The apparatus of claim 9 wherein the pivot arm comprises a single segment.

14. The plating apparatus of claim 9 further comprising a fluid duct in the pivot arm leading to the contactor.

15. The plating apparatus of claim 9 further including a detector on the pivot arm for detecting a condition of the seal.

16. The plating apparatus of claim 9 with the contactor below the seal when the contactor is in physical contact with the seal.

* * * * *